US005940970A

United States Patent [19]

D'Ambro, Sr. et al.

[11] Patent Number: 5,940,970

[45] Date of Patent: Aug. 24, 1999

[54] UTILITY KNIFE

[75] Inventors: Dominic D'Ambro, Sr., Malvern; Fred Griste, Exton; Gordon Milligan, Zieglerville, all of Pa.

[73] Assignee: Le-Jo Enterprises, Inc., Malvern, Pa.

[21] Appl. No.: 08/908,269

[22] Filed: Aug. 7, 1997

[51] Int. Cl.[6] ..... B26B 5/00

[52] U.S. Cl. ..... 30/125; 30/330; 30/331

[58] Field of Search ..... 30/125, 330, 340, 30/329, 331, 332

[56] References Cited

U.S. PATENT DOCUMENTS

| | | | |
|---|---|---|---|
| 1,202,299 | 10/1916 | Lutz, Jr. | 30/330 |
| 1,355,762 | 10/1920 | Kauneckas | 30/330 |
| 1,358,097 | 11/1920 | Neft . | |
| 1,629,412 | 5/1927 | Relich . | |
| 1,827,509 | 10/1931 | Ericsson . | |
| 3,257,726 | 6/1966 | Longobardi . | |
| 3,462,836 | 8/1969 | Knight et al. . | |
| 3,509,627 | 5/1970 | Gilbert et al. | 30/332 |
| 3,520,059 | 7/1970 | Gringer | 30/340 |
| 3,906,625 | 9/1975 | Gringer | 30/331 |
| 3,927,473 | 12/1975 | Braginetz | 30/125 |
| 4,005,525 | 2/1977 | Gringer | 30/125 |
| 4,047,298 | 9/1977 | Philippar | 30/153 |
| 4,109,380 | 8/1978 | Anderson | 30/162 |
| 4,240,202 | 12/1980 | Gilbert | 30/162 |
| 4,575,940 | 3/1986 | Wenzel | 30/335 |
| 4,662,070 | 5/1987 | Reddig | 30/125 |
| 4,713,884 | 12/1987 | Dunnagan | 30/339 |
| 4,817,284 | 4/1989 | Sacherman | 30/329 |
| 4,930,218 | 6/1990 | Jacoff | 30/162 |
| 5,022,156 | 6/1991 | Kallens et al. | 30/125 |
| 5,036,591 | 8/1991 | Cousins | 30/335 |
| 5,301,428 | 4/1994 | Wilcox | 30/162 |
| 5,566,452 | 10/1996 | Smaple | 30/120.2 |

*Primary Examiner*—Hwei-Siu Payer
*Attorney, Agent, or Firm*—Gary M. Cohen

[57] ABSTRACT

A utility knife includes a holder having two mating halves which combine to develop a first cavity located at a proximal end of the holder, for receiving a blade for active use, and a second cavity located toward a distal end of the holder, for receiving a supply of replacement blades. The two mating halves are joined by a hinge located at the distal end of the holder, and a closure in the form of a captive screw extending between the mating halves at a position between the first cavity and the second cavity. Both the first cavity and the second cavity incorporate a magnet for directly engaging the active blade, and for additionally engaging one or more stored replacement blades.

22 Claims, 3 Drawing Sheets

UTILITY KNIFE

BACKGROUND OF THE INVENTION

The present invention generally relates to a utility knife of improved construction, and more particularly, to a utility knife which facilitates installation and replacement of the blade, and which provides for increased safety during use.

A variety of utility knives have been developed for use in any of a number of applications. Whether intended for use in the construction trades, for packaging and shipping, for carpet installation, or some other purpose, it is in each case important for the knife to exhibit properties including safety, reliability and convenience in use. Moreover, to achieve public acceptance of the product, these characteristics must be delivered in a cost effective product.

In practice, it has been found that these several requirements often tend to conflict with one another. For this reason it is not uncommon for a particular design to sacrifice one of the above-mentioned factors in favor of another.

As an example, U.S. Pat. No. 5,301,428 (Wilcox) discloses a utility knife comprised of two mating halves joined at a central pivot to provide access to the active blade (for insertion and replacement) and a quantity of stored replacement blades. The end of the handle which is to receive the active blade is provided with paired tongues and slots for interlocking the mating halves of the handle when closed for use, to make sure that the blade is securely held in position during use.

However, the safety of the resulting closure is achieved at the expense of convenience in use, and overall cost. In practice, the pivoting mechanism of the handle is relatively cumbersome to operate when it becomes desirable to access the active blade. It has also been found to be relatively difficult to access the stored blades, and to install a replacement blade, without either the active blade or the replacement blade (or blades), or both, falling from the handle while such blade replacement is in progress. The potential for the active blade to fall from the handle during replacement exists even in the presence of a magnet which is used to secure the handle's blade carrier. In practice, the separation which is present between the blade and the magnet is sufficient to allow the blade to fall from the carrier when the handle is opened, leading to a significant compromise in safety.

Another example is the utility knife disclosed in U.S. Pat. No. 5,022,156 (Kallens et al.), which is also comprised of two mating halves having structure for receiving an active blade and a quantity of stored replacement blades. The disclosed tool handle incorporates features which are intended to simplify blade replacement. To this end, a fastener assembly is provided to facilitate separation of the mating halves for purposes of gaining access to the active blade, and the replacement blades stored in the tool handle. However, the convenience afforded by the disclosed closure is achieved at the expense of safety.

In practice, the spring-biased fastener assembly has been found to allow significant separation of the halves of the tool, at times allowing the active blade to be pulled from the handle during use. This can cause an exposed blade to become embedded in the work surface, leading to a significant potential for injury. It has also been found that during the installation of an active blade, or when installing a replacement blade, either the active blade or the replacement blade (or blades), or both, can freely fall from the handle, again leading to a significant compromise in safety.

It has therefore remained to provide a utility knife which is not only convenient to use, but which is also capable of operating safely and reliably both when in active use, and during the installation or replacement of the active blade.

SUMMARY OF THE INVENTION

It is therefore the primary object of the present invention to provide a utility knife which is safe, reliable and convenient to use.

It is also an object of the present invention to provide a utility knife which securely holds the active blade in position for use, without compromising blade installation and replacement.

It is also an object of the present invention to provide a utility knife which securely holds the active blade in position during use, and which also securely holds the active blade and any stored blades in position during blade installation and replacement.

It is also an object of the present invention to provide a utility knife having a closure mechanism which is convenient to use, and which is capable of both securely holding the active blade in position during use, and facilitating installation and replacement of the active blade.

It is also an object of the present invention to provide a utility knife having the foregoing improvements, yet which is low in cost, and inexpensive to manufacture.

These and other objects which will become apparent are achieved in accordance with the present invention by providing a utility knife which is generally comprised of a holder having two mating halves which combine to develop a first cavity located at a proximal end of the holder, for receiving a blade for active use, and a second cavity located toward a distal end of the holder, for receiving a supply of replacement blades. The two mating halves are joined by a hinge located at the distal end of the holder, and a closure extending between the mating halves at a position between the first cavity and the second cavity. Both the first cavity and the second cavity incorporate a magnet for directly engaging the active blade, and for additionally engaging one or more stored replacement blades.

In use, the mating halves of the holder, together with the closure which joins the mating halves, combine to securely hold the active blade in position for use while effectively eliminating the possibility that the active blade can become separated from the holder. Installation and replacement of the active blade is also facilitated by the closure and hinge which join the halves of the holder, which is easily opened to expose any active or stored blades, and by the magnets associated with the first and second cavities of the holder, which prevent blades from falling from the holder during this procedure.

For a further discussion of the utility knife of the present invention, reference is made to the detailed description which is provided below, taken in conjunction with the following illustrations.

DETAILED DESCRIPTION OF A PREFERRED EMBODIMENT

Figure 1:
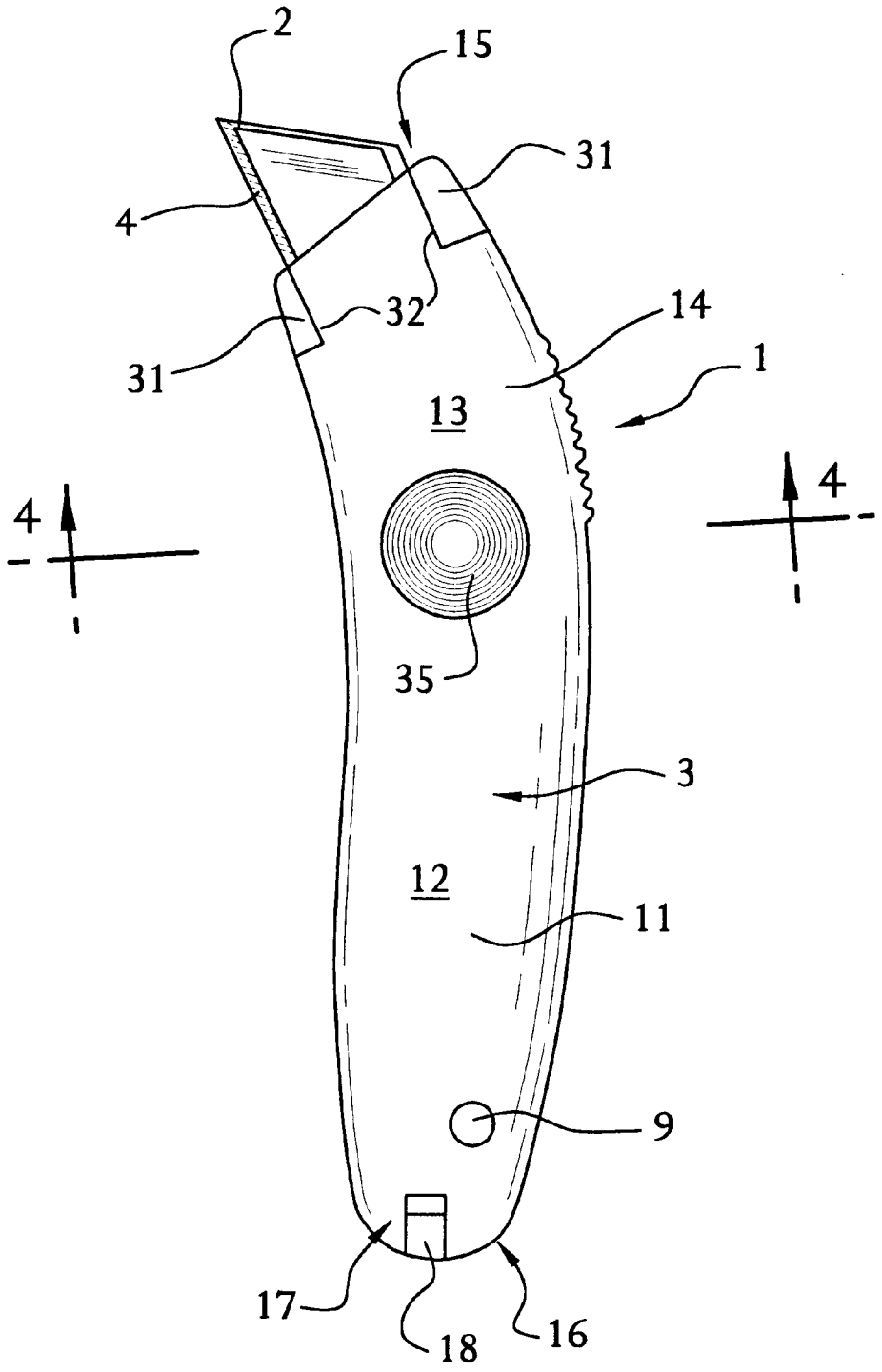
FIG. 1 is an elevational view of a utility knife produced in accordance with the present invention, in a closed position.

FIG. 1 shows a preferred embodiment utility knife 1. The knife 1 is generally comprised of a blade 2 and a holder 3 for securely receiving the blade 2, and for retaining the blade 2 in position for its intended use. The blade 2 includes a body for engagement within the holder 3, and a sharpened edge 4 exposed for active use. As is conventional, the blade 2 further includes a notch 5 (see FIG. 2) for interacting with the holder 3 as will be discussed more fully below. The blade 2 shown in the figures is a trapezoidal blade of conventional construction, which is shown only for purposes of illustration. It is to be understood that other blades having other configurations (including hook blades, serrated blades, trimming blades, skinning blades, or other blades having one or more notches 5) may also be used with the holder 3, if desired, provided the blade and the holder are suitably matched to one another.

Figure 2:
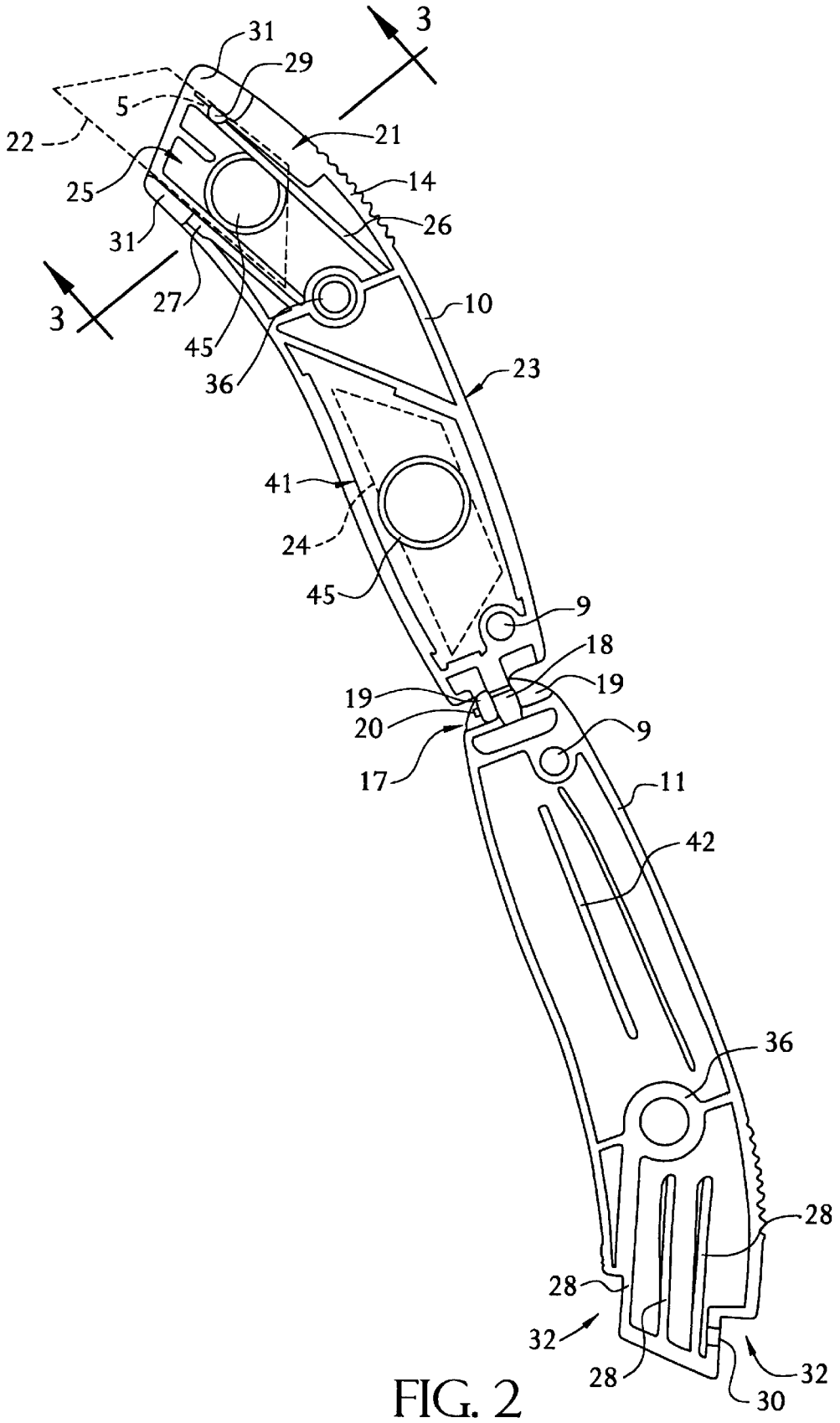
FIG. 2 is a top plan view of the utility knife of FIG. 1, in an opened position.

Referring now to FIGS. 1 and 2, the holder 3 is generally comprised of a mating pair of half sections 10, 11. The half sections 10, 11 combine to form a body 12 having a smoothly curving shape which is conveniently grasped by a user's hand. The body 12 terminates in a curved section 13 which is formed at an angle (on the order of 19°) for increasing the user's comfort while working with the knife 1. The body 12 is preferably and additionally provided with a series of ridges 14 for aiding the user in guiding the knife 1, and an aperture 9 which extends through and between the half sections 10, 11 for use in hanging the knife 1 from a desired support (e.g., a wall mounting, or from a work belt). The half sections 10, 11 of the holder 3 can be formed of any of a variety of materials, including plastics and metals, and can be molded or cast to their desired shape using any of a variety of known manufacturing techniques.

The holder 3 defined by the combined half sections 10, 11 includes a first, proximal end 15 for receiving the blade 2 so that the blade 2 suitably projects from the holder 3 (for its intended use), and a second, distal end 16 having a hinge 17 for pivotally joining the half sections 10, 11 of the holder 3 to one another. For purposes of forming the hinge 17, the half section 10 includes a single arm 18 projecting from the end 16 of the half section 10, and the half section 11 includes a pair of arms 19 projecting from the end 16 of the half section 11. The arm 18 of the half section 10 is positioned between the arms 19 of the half section 11, and the juxtaposed arms 18, 19 are then joined by a hinge pin 20 so that the half sections 10, 11 are capable of pivoting relative to one another between the opened position shown in FIG. 2 and the closed position shown in FIG. 1. In the closed position of FIG. 1, the half sections 10, 11 are caused to come into alignment with one another so that a substantially seamless handle is made available for active use. Each of the arms 18, 19 is preferably curved to provide the end 16 of the holder 3 with a smooth outer surface, for purposes of comfort and safety.

As is best shown in FIG. 2, the holder 3 includes internal structure for separating the interior of the holder 3 into two cavities. A first cavity 21 is provided for receiving an active blade (shown in phantom at 22) so that the blade 22 projects from the end 15 of the holder 3 (i.e., the blade 2 of FIG. 1). A second cavity 23 is provided for receiving one or more replacement blades (shown in phantom at 24) for replenishing an active blade which has become worn from use.

The cavity 21 is defined between cooperating structures formed in the half sections 10, 11. To this end, the half section 10 includes a channel 25 defined between a pair of flanges 26, 27 and sized to receive the active blade 22, and the half section 11 includes a cooperating series of ribs 28 sized to extend into the channel 25 upon closure of the half sections 10, 11 so that a blade positioned in the cavity 21 is snugly grasped between the flanges 26, 27 of the half section 10 and the ribs 28 of the half section 11. The flange 26 of the channel 25 is further provided with a projection 29 for engaging the notch 5 formed in the body of the blade 2, as previously described, and the half section 11 is provided with a corresponding opening 30 for receiving the projection 29 upon closure of the half sections 10, 11. In this way the projection 29 and the opening 30 combine to capture the notch 5, while the flanges 26, 27 and the ribs 28 cooperate to safely and securely clamp the active blade 22 within the holder 3 during active use of the knife 1.

Figure 3:
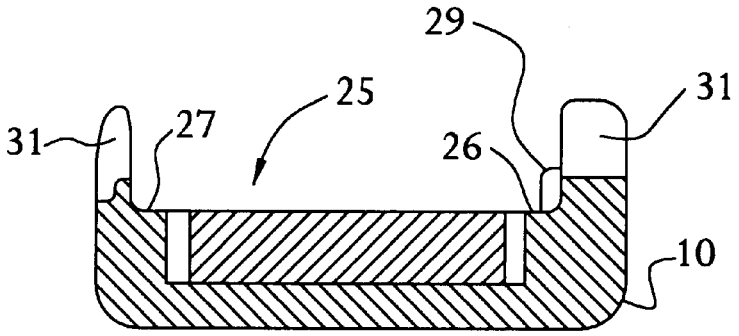
FIG. 3 is a sectional view of the utility knife of FIG. 2, taken along the line 3—3.

As is best shown in FIG. 3, the proximal end of the channel 25 further includes a pair of cross-over lugs 31 in alignment with the flanges 26, 27 for receiving the active blade 22. The cross-over lugs 31 project upwardly from the channel 25, for engaging corresponding notches 32 formed in the half section 11 (adjacent to the ribs 28). The cross-over lugs 31 operate to strengthen the enclosure developed upon closing the half sections 10, 11, at the end 15, and prevent the active blade 22 from being rotated from the cavity 21 which receives it responsive to forces applied to the active blade 22 during use of the knife 1.

Figure 4:
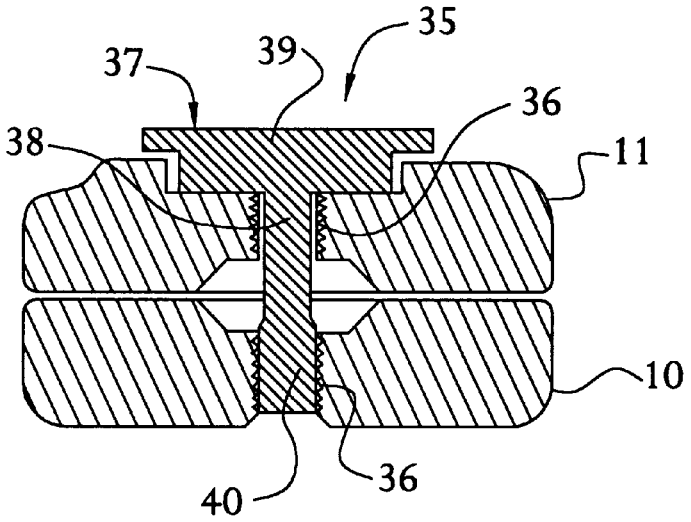
FIG. 4 is a sectional view of the utility knife of FIG. 1, taken along the line 4—4.

A closure 35 is provided to join the respective half sections 10, 11 forming the holder 3, and to retain the active blade 22 within the holder 3 during use. The closure 35 is preferably positioned toward the center of the holder 3, and in a particularly preferred embodiment, is positioned just behind the cavity 21 which receives the active blade 22 (between the cavity 21 and the cavity 23). As is best shown in FIG. 4, the closure 35 is advantageously implemented as a pair of threaded apertures 36, formed in each of the half sections 10, 11, coupled with a captive screw 37 for joining the half sections 10, 11 together at the closure 35. The captive screw 37 includes a central shaft 38, one end of which includes a knurled thumb-screw portion 39 and the other end of which is provided with a threaded section 40. The captive screw 37 is threaded into the aperture 36 of one of the half sections (in this case the half section 11), for engaging the aperture 36 in the remaining half section (in this case the half section 10). Interaction between the threaded section 40 of the captive screw 37 and the aperture 36 of the half section 11 operates to securely retain the captive screw 37 in position within the holder 3 so that the captive screw 37 is conveniently available for closing the holder 3, when desired. The knurled portion 39 provides a convenient means for opening and closing the holder 3, as previously described, for servicing of the active blade 22.

The cavity 23 is also defined between cooperating structures formed in the half sections 10, 11. To this end, the half section 10 includes an open region 41 and the half section 11 includes a cooperating rib 42 positioned to extend over the region 41 upon closure of the half sections 10, 11. A quantity of replacement blades 24 can then be positioned within the cavity 23 and stored within the body 12 of the holder 3.

The cavity 21 for receiving the active blade 22 and the cavity 23 for receiving the replacement blades 24 are preferably each provided with a magnet 45. Each magnet 45 is preferably position within its respective cavity to directly engage a blade immediately adjacent to the magnet 45. In this way, the magnet 45 associated with the cavity 21 is positioned for direct engagement of the active blade 22, and the magnet 45 associated with the cavity 23 is positioned for direct engagement of a first one of the replacement blades 24. Through suitable adjustment of the forces produced by the magnet 45 associated with the cavity 23, sufficient forces can be developed for engaging any other blades 24 to be stored in the cavity 23. In this way, the magnets 45 combine to safely retain any blades 2 associated with the holder 3 within their respective cavities 21, 23 when the holder 3 is opened for servicing.

The foregoing features combine to provide a knife 1 which is not only convenient to use, but which is significantly safer (in use and during servicing) than previously available utility knife constructions. In use, the active blade 22 is safely and securely held within the cavity 21 by the cooperating projection 29 and opening 30, and between the channel 25 of the half section 10 and the ribs 28 of the half section 11. The strong clamping forces produced by the closure 35 operate to retain the active blade 22 in this position while in active use. To this end, the projection 29 and the opening 30 are clamped over the notch 5 of the blade 22, preventing the blade 22 from being pulled from the holder 3 even in the presence of severe torques applied to the active blade 22 during use of the knife 1. The extended cross-over lugs 31 associated with the end 15 of the holder 3 operate to prevent the active blade 22 from being rotated from between the half sections 10, 11 responsive to forces applied to the active blade 22 during use of the knife 1.

Yet, at the same time, the knife 1 is easily and conveniently serviced. The holder 3 is easily opened for installation or replacement of the active blade 22 by releasing the captive screw 37 and separating the half sections 10, 11. When opened, and during servicing, all of the components associated with the knife 1 are safely and securely retained in position so that none of the components can separate or fall from the knife 1. This includes the active blade 22, any replacement blades 24, the half sections 10, 11, as well as the captive screw 37. The knife 1 is then easily closed and locked down using the captive screw 37, completing servicing and restoring all of the safety features associated with active use of the knife 1.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A utility knife for receiving an active blade, comprising:

a pair of half sections having a mating configuration and capable of combining to form a holder having a proximal end for receiving the active blade, and a distal end including a hinge connecting the half sections so that the half sections are capable of relative movement between an opened position and a closed position; and a closure capable of extending between the half sections at a position between the proximal end and the distal end, for retaining the half sections in the closed position;

wherein the pair of half sections in the closed position combine to define a first cavity for receiving the active blade so that the active blade extends from the proximal end, and a second cavity positioned between the first cavity and the distal end for receiving additional blades stored for use with the utility knife;

wherein the closure cooperates with the half sections to clamp the active blade within the first cavity by clamping the half sections together when in the closed position;

wherein the first cavity includes a first magnet for directly engaging the active blade and the second cavity includes a second magnet for directly engaging one of the additional blades adjacent to the second magnet; and wherein the first cavity includes a channel defined between a pair of flanges and sized to receive the active blade, associated with one of the half sections, and a series of ribs sized to extend into the channel upon closure of the half sections, associated with the other one of the half sections, so that the active blade positioned in the first cavity is snugly grasped between the flanges and the ribs;

thereby securely joining the half sections and safely retaining the active blade in position for use when in the closed position, and retaining the half sections, the closure, the active blade and the additional blades together when in the opened position.

2. The utility knife of claim 1 wherein the closure is a captive screw extending through body portions of the knife, and between the half sections.

3. The utility knife of claim 2 wherein the captive screw includes a central shaft, a knurled thumb-screw portion at a first end of the central shaft, and a threaded section at a second, opposite end of the central shaft.

4. The utility knife of claim 3 wherein each of the body portions includes a threaded aperture for receiving the threaded section of the captive screw.

5. The utility knife of claim 4 wherein the threaded section of the captive screw is associated with the threaded aperture of one of the body portions so that the central shaft is slidingly received within the threaded aperture and the threaded section and the thumb-screw portion of the captive screw are maintained in position on opposite sides of the threaded aperture.

6. The utility knife of claim 5 wherein the threaded section of the captive screw and the threaded aperture of the one of the body portions receiving the captive screw are correspondingly sized so that the captive screw is retained within the threaded aperture.

7. The utility knife of claim 2 wherein the captive screw extends through the body portions at a position between the first cavity and the second cavity.

8. The utility knife of claim 1 wherein the hinge includes an arm extending from the distal end of one of the half sections surrounded by a pair of arms extending from the distal end of the other one of the half sections, joined by a hinge pin.

9. The utility knife of claim 1 wherein one of the flanges further includes a projection for engaging a notch formed in the active blade.

10. The utility knife of claim 9 wherein an opening is associated with the series of ribs for receiving the projection therein.

11. The utility knife of claim 1 wherein the first cavity further includes a pair of cross-over lugs projecting upwardly from the channel and in alignment with each of the flanges, associated with one of the half sections, and a corresponding pair of notches formed in the other one of the half sections for receiving the cross-over lugs upon closure of the half sections.

12. The utility knife of claim 1 wherein the first magnet is positioned in the channel, in alignment with the active blade.

13. The utility knife of claim 1 wherein the second cavity includes an open region for receiving the additional blades, associated with one of the half sections, and a rib extending over the open region upon closure of the half sections, associated with the other one of the half sections, so that the additional blades are retained within the second cavity.

14. The utility knife of claim 13 wherein the second magnet is positioned in the open region, in alignment with the additional blades.

15. The utility knife of claim 14 wherein the second magnet produces a force sufficient to retain a plurality of the additional blades within the open region.

16. A utility knife for receiving an active blade, comprising:

a pair of half sections having a mating configuration and capable of combining to form a holder having a proximal end for receiving the active blade, and a distal end, wherein the half sections are mated so that the half sections are capable of assuming an opened position and a closed position; and a closure capable of extending between the half sections at a position between the proximal end and the distal end, for retaining the half sections in the closed position;

wherein the pair of half sections in the closed position combine to define a first cavity for receiving the active blade so that the active blade extends from the proximal end, and a second cavity positioned between the first cavity and the distal end for receiving additional blades stored for use with the utility knife;

wherein the closure cooperates with the half sections to clamp the active blade within the first cavity by clamping the half sections together when in the closed position; and wherein the first cavity includes a channel defined between a pair of flanges and sized to receive the active blade, associated with one of the half sections, and a series of ribs sized to extend into the channel upon closure of the half sections, associated with the other one of the half sections, so that the active blade positioned in the first cavity is snugly grasped between the flanges and the ribs;

thereby securely joining the half sections and safely retaining the active blade in position for use when in the closed position and responsive to torques applied to the active blade when in use.

17. The utility knife of claim 16 wherein one of the flanges further includes a projection for engaging a notch formed in the active blade.

18. The utility knife of claim 17 wherein an opening is associated with the series of ribs for receiving the projection therein.

19. The utility knife of claim 16 wherein the first cavity further includes a pair of cross-over lugs projecting upwardly from the channel and in alignment with each of the flanges, associated with one of the half sections, and a corresponding pair of notches formed in the other one of the half sections for receiving the cross-over lugs upon closure of the half sections.

20. A utility knife for receiving an active blade, comprising:

a pair of half sections having a mating configuration and capable of combining to form a holder having a proximal end for receiving the active blade, and a distal end including a hinge connecting the half sections so that the half sections are capable of relative movement between an opened position and a closed position; and a closure capable of extending between the half sections at a position between the proximal end and the distal end, for retaining the half sections in the closed position;

wherein the pair of half sections in the closed position combine to define a first cavity for receiving the active blade so that the active blade extends from the proximal end, and a second cavity positioned between the first cavity and the distal end for receiving additional blades stored for use with the utility knife;

wherein the closure cooperates with the half sections to clamp the active blade within the first cavity by clamping the half sections together when in the closed position;

wherein the first cavity includes a first magnet for directly engaging the active blade and the second cavity includes a second magnet for directly engaging one of the additional blades adjacent to the second magnet; and wherein the second cavity includes an open region for receiving the additional blades, associated with one of the half sections, and a rib extending over the open region upon closure of the half sections, associated with the other one of the half sections, so that the additional blades are retained within the second cavity;

thereby securely joining the half sections and safely retaining the active blade in position for use when in the closed position, and retaining the half sections, the closure, the active blade and the additional blades together when in the opened position.

21. The utility knife of claim 20 wherein the second magnet is positioned in the open region, in alignment with the additional blades.

22. The utility knife of claim 21 wherein the second magnet produces a force sufficient to retain a plurality of the additional blades within the open region.

* * * * *